US006585041B2

(12) United States Patent
Crossley

(10) Patent No.: US 6,585,041 B2
(45) Date of Patent: Jul. 1, 2003

(54) VIRTUAL SENSORS TO PROVIDE EXPANDED DOWNHOLE INSTRUMENTATION FOR ELECTRICAL SUBMERSIBLE PUMPS (ESPS)

(75) Inventor: Alexander Crossley, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/911,298

(22) Filed: Jul. 23, 2001

(65) Prior Publication Data

US 2003/0015320 A1 Jan. 23, 2003

(51) Int. Cl.[7] ..... E21B 43/12
(52) U.S. Cl. ..... 166/53; 166/250.15
(58) Field of Search ..... 166/53, 66, 65.1, 166/250.01, 250.15

(56) References Cited

U.S. PATENT DOCUMENTS 4,854,164 A * 8/1989 Rhoads ..... 166/53
5,146,991 A * 9/1992 Rogers, Jr. ..... 166/369
5,826,659 A * 10/1998 Hershberger ..... 166/372
5,829,530 A * 11/1998 Nolen ..... 166/369
5,941,305 A 8/1999 Thrasher et al.
5,992,519 A 11/1999 Ramakrishnan et al.
6,041,856 A * 3/2000 Thrasher et al. ..... 166/53
6,167,965 B1 * 1/2001 Bearden et al. ..... 166/250.15
6,310,559 B1 * 10/2001 Laborde et al. ..... 166/370

FOREIGN PATENT DOCUMENTS

WO WO 94/25732 11/1994
WO WO 00/00715 1/2000

* cited by examiner

*Primary Examiner*—Frank Tsay

(57) ABSTRACT

Complex algorithms and calculations such as multi-phase flow correlations, together with mathematical models which include the dynamic behavior of the wellbore or artificial lift equipment and the components therein (e.g., a variable speed drive, power cable, seal and pump) are employed to derive or compute information relevant to production based upon actual measurements made during operation. The derived or computed values, typically for parameters such as torque which are difficult to measure during operation, are provided with the measurements for control purposes. Improved optimization of production based on an expanded set of parameters is therefore enabled.

20 Claims, 3 Drawing Sheets

VIRTUAL SENSORS TO PROVIDE EXPANDED DOWNHOLE INSTRUMENTATION FOR ELECTRICAL SUBMERSIBLE PUMPS (ESPS)

CROSS-REFERENCE TO RELATED APPLICATIONS

This application is related to the subject matter of commonly assigned, co-pending U.S. patent application Ser. No. 09/617,305 entitled R/F COMMUNICATION WITH DOWNHOLE EQUIPMENT and filed Jul. 17, 2000, which is a continuation-in-part of U.S. Pat. No. 6,167,965 entitled ELECTRICAL SUBMERSIBLE PUMPS AND METHODS FOR ENHANCED UTILIZATION OF ELECTRICAL SUBMERSIBLE PUMPS IN THE COMPLETION AND PRODUCTION OF WELLBORES. The content of the above-identified patent(s) and patent application(s) is hereby incorporated by reference.

TECHNICAL FIELD OF THE INVENTION

The present invention is directed, in general, to measurement and control systems for subterranean bore hole equipment and, more specifically, to measurement and control systems providing extended data with regard to operation of electrical submersible pumps.

BACKGROUND OF THE INVENTION

Optimization of production processes within a wellbore, particularly processes employing artificial lift equipment such as electrical submersible pumps, requires actual performance data. Measurements relating to the operation of the pump, the motor, and the flow of fluids and/or gases produced by the pump are desired to maintain production at conditions as close to optimal as possible.

Measurement of some parameters associated with operation of an electrical submersible pump downhole is relatively straightforward. Measurement of pump intake pressure, motor temperature and motor current, for instance, is accomplished with relative ease. Other parameters, however, are very difficult or even impossible to measure during operation, such as motor and/or pump torque, pump intake viscosity and specific gravity, net flowrates, and the like. However, when more parameters are available for consideration in making control decisions, production control and tuning of pump operation for optimal performance is improved.

There is, therefore, a need in the art for a system providing an enhanced set of parameters relating to operation of artificial lift equipment for use in production control.

SUMMARY OF THE INVENTION

To address the above-discussed deficiencies of the prior art, it is a primary object of the present invention to provide, for use in monitoring and/or controlling downhole equipment, a system employing complex algorithms and calculations such as multi-phase flow correlations. Such complex algorithms and calculations, together with mathematical models that include the dynamic behavior of artificial lift equipment and the components therein (e.g., a variable speed drive, power cable, seal and pump) to derive or compute information relevant to production based upon actual measurements made during operation. The derived or computed values, typically for parameters such as torque which are difficult to measure during operation, are provided with the measurements for control purposes. Improved optimization of production based on an expanded set of parameters is therefore enabled.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the DETAILED DESCRIPTION OF THE INVENTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

Figure 1:
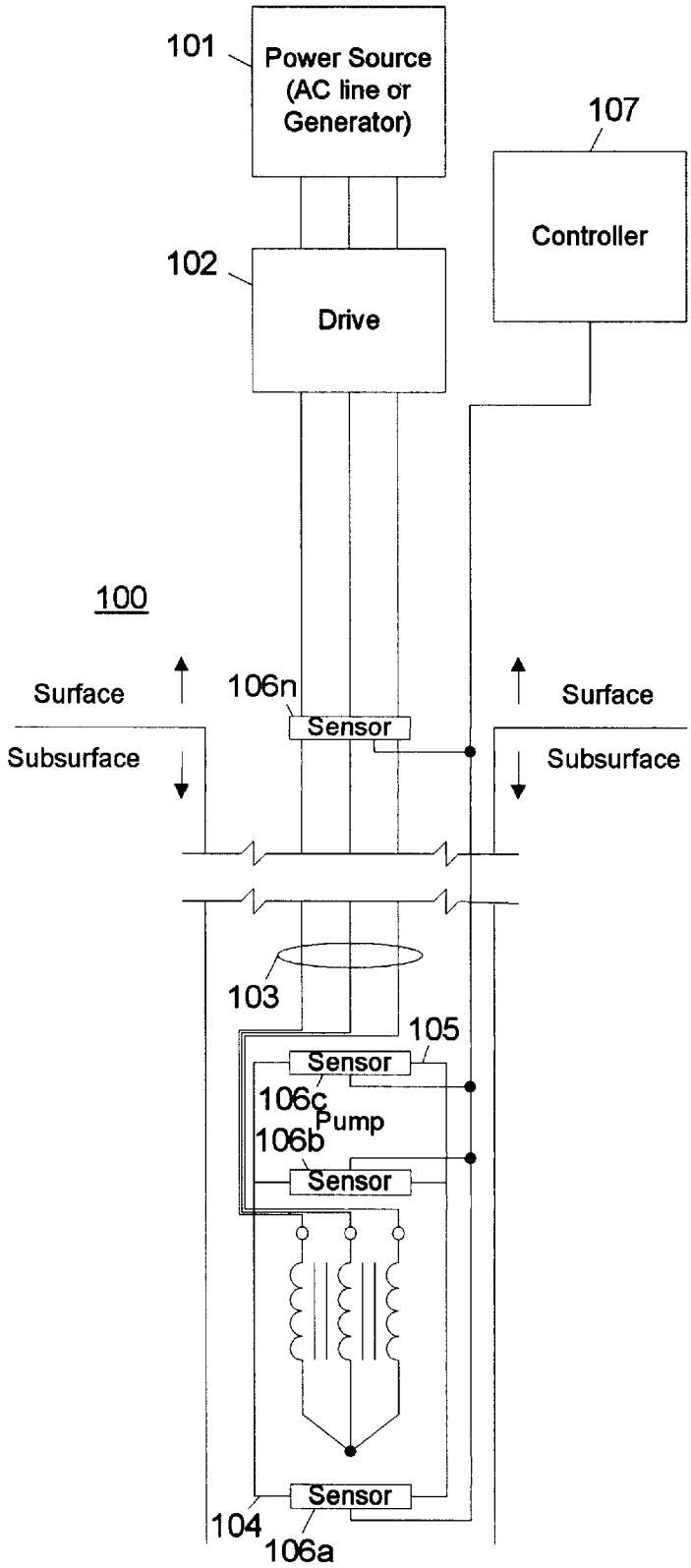
FIG. 1 depicts a downhole production system according to one embodiment of the present invention.
Figure 2:
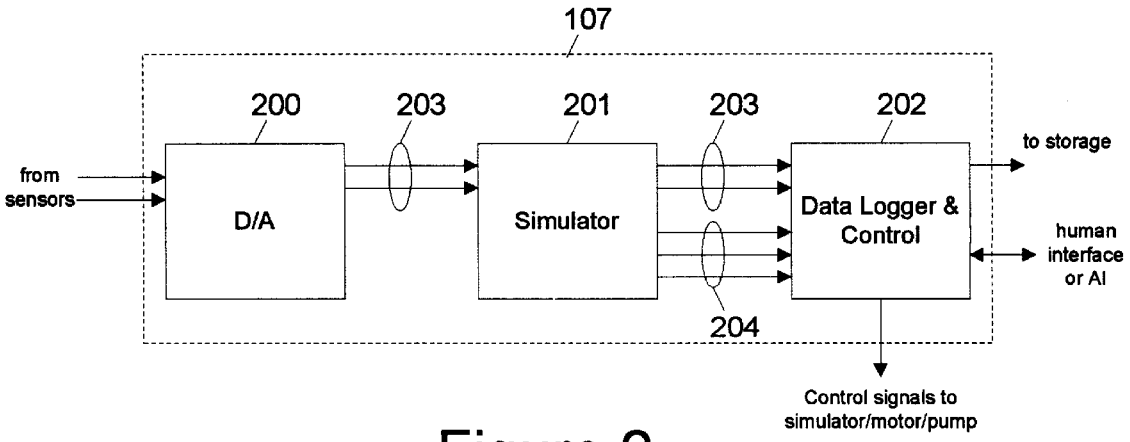
FIG. 2 illustrates in greater detail for a controller for a data acquisition, logging, and production control system enhancing the set of available parameters related to downhole production according to one embodiment of the present invention.
Figure 3:
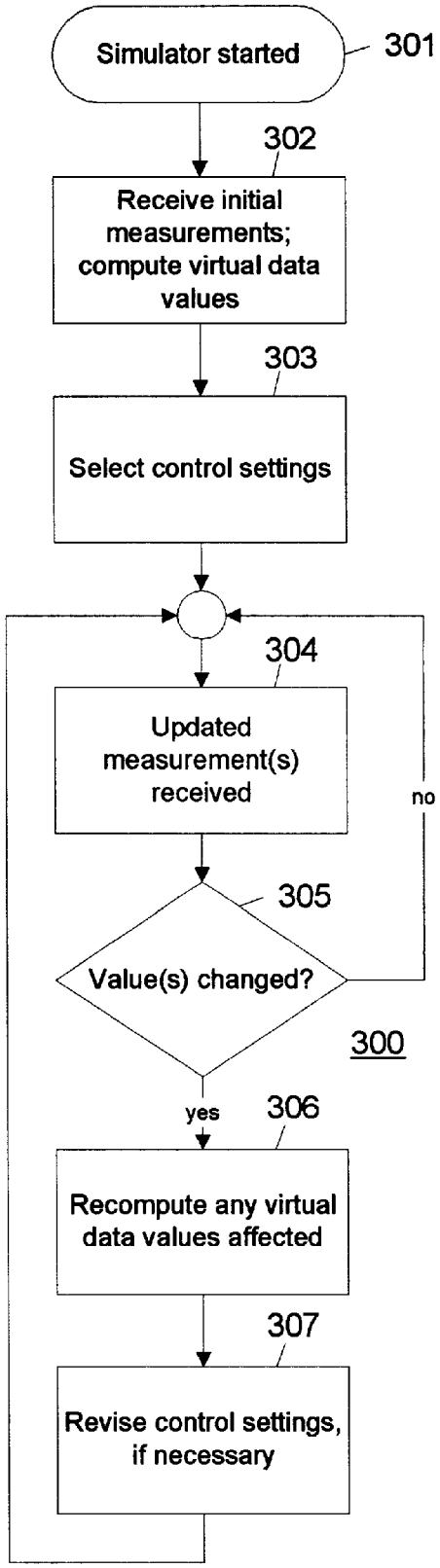
FIG. 3 depicts a high level flow chart for a process of enhancing the set of available parameters related to downhole production according to one embodiment of the present invention.

FIGS. 1 through 3, discussed below, and the various embodiment used to describe the principles of the present invention in this patent document are by way of illustration only and should not be construed in any way to limit the scope of the invention. Those skilled in the art will understand that the principles of the present invention may be implemented in any suitably arranged device.

FIG. 1 depicts a downhole production system according to one embodiment of the present invention. The downhole production system 100 includes a power source comprising an alternating current power source such as an electric power line (coupled to a local power utility) or a generator 101 and, in the exemplary embodiment, a pulse width modulated (PWM) variable frequency drive (VFD) 102 (or a switchboard or other equivalent controller) located at the surface of a borehole and coupled by a power transmission cable 103 to an induction motor 104 disposed within the borehole by connection to tubing (not shown) lowered within the well casing.

The downhole production system 100 also includes artificial lift equipment for aiding production, which comprises an electrical submersible motor 104 and, in the exemplary embodiment, a pump 105, which may be of the type disclosed in U.S. Pat. No. 5,845,709. Motor 104 is mechanically coupled to and drives the pump 105, which induces flow of gases and fluids up the borehole. Cable 103, motor 104 and pump 105, together with a seal (not shown), preferably form an electrical submersible pump (ESP) system in accordance with the known art.

Downhole production system 100 also includes a data acquisition, logging (recording), and control system, which comprises sensors 106*a*–106*n* (which may include any number of sensors) and a controller 107. Sensors 106*a*–106*n* are located downhole within or proximate to motor 104, pump 105, or at other locations within the borehole (e.g., at the wellhead of a subsea borehole). Sensors 106*a*–106*n* monitor various conditions within the borehole, such as vibration, ambient wellbore fluid temperature, ambient wellbore fluid pressure, motor voltage and/or current, motor speed (revolutions per minute), motor oil pressure, motor oil temperature, pump intake pressure, fluid pressure at one or more stages of the pump, fluid temperature at one or more stages of the pump, pump speed, pump output pressure, pump output flow rate, pump output fluid temperature, and the like.

Sensors 106*a*–106*n* communicate respective measurements on at least a periodic basis to controller 107 utilizing known techniques, such as, for example, those disclosed in commonly-assigned co-pending U.S. patent applications Ser. No.: 09/566,841, entitled METHOD FOR MULTI-PHASE DATA COMMUNICATIONS AND CONTROL OVER AN ESP POWER CABLE and filed May 5, 2000; and U.S. Ser. No. 09/617,305, entitled RF COMMUNICATION WITH DOWNHOLE EQUIPMENT and filed Jul. 17, 2000. The content of the above-identified applications is incorporated herein by reference.

Controller 107 may similarly communicate control signals to either the motor 104, the pump 105, or both utilizing the techniques described in the above-identified applications. Such control signals regulate operation of the motor 104 and/or pump 105 to optimize production in accordance with known techniques.

FIG. 2 illustrates in greater detail a controller for a data acquisition, logging, and production control system enhancing the set of available parameters related to downhole production according to one embodiment of the present invention. Controller 107 in the exemplary embodiment includes three principal components: a data acquisition unit 200, a simulator 201, and a data logger and controller 202. Data acquisition unit 200, which is coupled to the sensors 106*a*–106*n* depicted in FIG. 1, buffers measurements received from sensors 106*a*–106*n* and coordinates transmission of such measurements to other portions of controller 107. Simulator 201 receives the measured data 203 and generates an expanded set of data including "virtual" measurements 204 as described in further detail below.

Data logger and controller 202 receives the measured data 203 and virtual data 204 and forwards such data 203 and 204 to a storage device (e.g., a magnetic hard drive) for storage. Control unit 202 also forwards the data 203 and 204 to a human interface (e.g., display and/or input/output device such a keyboard, mouse, etc.) or an artificial intelligence process. Additionally, control unit 202 performs pre-selected computations on, and applies predefined rules to, the received data 203 and 204 (and the results of the computations) to generate control signals for controlling operation of the motor 104, the pump 105, or both for optimal production performance in accordance with the known art. In addition, control unit 202 may control surface equipment, such as a well-head valve, or other downhole completion equipment, such as safety valves, sliding sleeves, and the like, via the control signals. The control signals are returned to simulator 201 as well as to motor 104 and/or pump 105.

Although each value for measured and virtual data 203 and 204 is depicted in FIG. 2 as being transmitted over separate data paths, the values may instead be transmitted as fields within a single data stream. Similarly, while measured data 203 is depicted as routed through simulator 201, such data 203 may alternatively be passed directly from data acquisition unit 200 to data logger and control unit 202.

Simulator 201, upon receiving measured data 203, utilizes well-known multi-phase flow correlations (e.g., Hagedorn & Brown, Beggs & Brill, etc.) or other well known friction gradient computational methods (i.e., Hazen Williams), in addition to mathematical models of the dynamic behavior of artificial lift equipment (e.g., variable frequency drives and electrical submersible pumps in the exemplary embodiment) and the components therein to compute additional parameters which may be derived from the measured data 203. Such additional parameters are typically secondary calculated variables which cannot easily be directly measured, such as fluid viscosity and specific gravity at the pump intake, net flow rates at the pump intake and/or output, pump and/or motor torque. The expanded set of available data 203 and 204 provides more accurate control for optimization of production.

For electrical submersible pumps of the type employed in the exemplary embodiment, various commercial "sizing" programs are available which utilize multi-phase flow correlations and mathematical pump modeling for selection of the appropriate number of segments to employ for an electrical submersible pump under specific conditions. An example of such electrical submersible pump sizing products is AutographPC, a software package which is currently available at www.centrilift.com/OS/autograph/autograph.htm from the Centrilift division of Baker Hughes Incorporated, although similar software packages are available from other vendors.

The AutographPC package identified above includes the capability of altering various downhole conditions to determine the effect on other parameters (e.g., altering the frequency of power to a variable speed drive to observe the effects on the pump's operating point). If alternative software packages are employed, such a capability should be available or added. The current version of the AutographPC package also exposes objects and methods (using ActiveX and COM technologies) for use from other software.

The electrical submersible pump sizing application, and the dynamic modeling employed therein, may be readily adapted to perform the extrapolation or derivation of virtual data 204 from measured data 203. In this regard, simulator 201 need not provide a complete simulation of the operation of the artificial lift equipment, but instead need only be capable of calculating values for the virtual data 204 of interest from the available values of measured data 203 utilizing the correlations and dynamic modeling.

Simulator 201 continuously computes values for parameters such as pressures, flowrates, temperatures, torques, voltages, and currents which are not measured (either due to difficulty in measurement or to improved efficiency of calculating such values). The expanded set of values, including measured data 203 and virtual data 204, is exposed to the control system for use in optimizing production performance (e.g., on/off controls to provide synchronization). The computed values are treated by the control system as having been measured by virtual sensors.

As used herein, the term "simulator" is intended to encompass without limitation any hardware, firmware, software or combination thereof which is adapted to perform such correlations, derivations and computations. For example, simulator 201 may be implemented as simply a set of routines which run in an uninterrupted loop, receiving as input the measured data 203 and any user or operator input to generate an extended set of data 203 and 204 suitable for use in controlling operation of the motor, pump, or other production component.

It should be noted that controller 107 may be implemented on a single data processing system or on a distributed network of data processing systems. Moreover, the functions performed by data acquisition unit 200, simulator 201, and/or data logger and control unit 202, or any subset thereof, may be merged into a single functional unit.

FIG. 3 depicts a high level flow chart for a process of enhancing the set of available parameters related to downhole production according to one embodiment of the present invention. The process is implemented within a downhole production system as disclosed and described above in connection with FIGS. 2 and 3. The process 300 begins with the simulator being started (step 301), and proceeds to receipt of initial measurements from the data acquisition system and computation of virtual data values based upon the received measurements utilizing multi-phase flow correlations and mathematical modeling for the dynamic behavior of the artificial lift equipment employed (step 302). Control settings for the artificial lift equipment are then selected (step 303).

Updated measurements for production parameters are then received (step 304). In the exemplary embodiment, a determination is made of whether any of the values for the measured parameters have changed since the initial or last measurement (step 305). If not, the process simply returns to await a further update of the measurements.

If the value for a measured parameter has changed, however, the process proceeds instead to recomputation of any virtual data values which may be affected by the changes (step 306) and revision of the production control settings, if necessary (step 307), before returning to await further updated measurements.

The present invention allows an expanded set of production parameters, including parameters which are difficult if not impossible to directly measure during operation, to be employed in controlling production within a wellbore. By virtue of the additional information, optimization of production may be improved. The derivation of the additional "virtual" parameter values is based on known multi-phase flow correlations and dynamic modeling of the artificial lift equipment employed, and may be integrated readily into existing production systems.

Although one or more embodiments of the present invention have been described in detail, those skilled in the art will understand that various changes, substitutions and alterations herein may be made without departing from the spirit and scope of the invention it its broadest form.

What is claimed is:

1. For use in a downhole production monitoring and control system, a system for extending a set of parameters on which control decisions are predicated comprising:

a simulator capable of selectively receiving measurements for a first set of parameters obtained during operation of artificial lift equipment within a wellbore, wherein the simulator, upon receiving the measurements, calculates values for a second set of parameters different than the first set of parameters and relating to the operation of the artificial lift equipment within the wellbore, wherein the simulator calculates the values for the second set of parameters based upon the measurements utilizing at least one of multi-phase flow correlations, other friction and elevation gradient calculation methods, and mathematical models incorporating dynamic behavior for the wellbore or the artificial lift equipment, wherein the values for the second set of parameters are available from the simulator during operation of the corresponding artificial lift equipment and may be selectively employed in controlling subsequent operation of the artificial lift equipment.

2. The system of claim 1 further comprising:

a control unit receiving the measurements for the first set of parameters and the values for the second sets of parameters and selectively generating control signals based upon the measurements and the values to control subsequent operation of the artificial lift equipment.

3. The system of claim 2 further comprising:

at least one sensor providing the measurements for the first set of parameters on at least a periodic basis.

4. The system of claim 1 wherein the values for the second set of parameters are updated in a synchronized manner with the measurements for the first set of parameters.

5. The system of claim 1 wherein the second set of parameters includes at least one of torque, net flow rate through the artificial lift equipment, viscosity of fluids pumped by the artificial lift equipment, and specific gravity of fluids pumped by the artificial lift equipment.

6. The system of claim 1 wherein the values for the second set of parameters are employed to optimize production or to match performance of the artificial lift equipment to wellbore application parameters.

7. The system of claim 1 wherein the artificial lift equipment includes a variable speed drive and an electrical submersible pump.

8. A downhole production system, comprising:

artificial lift equipment disposed within a borehole;

a variable speed drive providing power to the artificial lift equipment;

a controller controlling operation of at least one of the artificial lift equipment and the variable speed drive; and a system for extending a set of parameters on which control decisions are predicated comprising:

a simulator within or accessible to the controller, the simulator capable of selectively receiving measurements for a first set of parameters obtained during operation of artificial lift equipment within a wellbore, wherein the simulator, upon receiving the measurements, calculates values for a second set of parameters different than the first set of parameters and relating to the operation of the artificial lift equipment within the wellbore, wherein the simulator calculates the values for the second set of parameters based upon the measurements utilizing at least one of multi-phase flow correlations, other friction and elevation gradient calculation methods, and mathematical models incorporating dynamic behavior of the wellbore or the artificial lift equipment, wherein the values for the second set of parameters are available from the simulator during operation of the corresponding artificial lift equipment and may be selectively employed in controlling subsequent operation of the artificial lift equipment.

9. The system of claim 8 further comprising:

a control unit receiving the measurements for the first set of parameters and the values for the second sets of parameters and selectively generating control signals based upon the measurements and the values to control subsequent operation of the artificial lift equipment.

10. The system of claim 9 further comprising:

at least one sensor providing the measurements for the first set of parameters on at least a periodic basis.

11. The system of claim 8 wherein the values for the second set of parameters are updated in a synchronized manner with the first set of parameters.

12. The system of claim 8 wherein the second set of parameters includes at least one of torque, net flow rate through the artificial lift equipment, viscosity of fluids pumped by the artificial lift equipment, and specific gravity of fluids pumped by the artificial lift equipment.

13. The system of claim 8 wherein the values for the second set of parameters are employed to optimize production or to match performance of the artificial lift equipment to wellbore application parameters.

14. The system of claim 1 wherein the artificial lift equipment includes a variable speed drive and an electrical submersible pump.

15. For use in a downhole production system, a method of extending a set of parameters on which control decisions are predicated comprising:

receiving measurements for a first set of parameters obtained during operation of artificial lift equipment within a wellbore;

upon receiving the measurements, calculating values for a second set of parameters different than the first set of parameters and relating to the operation of the artificial lift equipment within the wellbore, wherein the values for the second set of parameters are calculated based upon the measurements utilizing at least one of multi-phase flow correlations, other friction and elevation gradient calculation methods, and mathematical models incorporating dynamic behavior for the wellbore or the artificial lift equipment; and employing the values for the second set of parameters to control subsequent operation of the artificial lift equipment.

16. The method of claim 15 wherein the step of employing the values for the second set of parameters to control subsequent operation of the artificial lift equipment further comprises:

receiving the measurements for the first set of parameters and the values for the second sets of parameters and selectively generating control signals based upon the measurements and the values to control subsequent operation of the artificial lift equipment.

17. The method of claim 16 further comprising:

acquiring the measurements for the first set of parameters on at least a periodic basis.

18. The method of claim 15 further comprising:

updating the values for the second set of parameters in a synchronized manner with the measurements for the first set of parameters.

19. The method of claim 15 wherein the step of calculating values for a second set of parameters different than the first set of parameters and relating to the operation of the artificial lift equipment within the wellbore further comprises:

calculating at least one of torque, net flow rate through the artificial lift equipment, viscosity of fluids pumped by the artificial lift equipment, and specific gravity of fluids pumped by the artificial lift equipment.

20. The method of claim 15, wherein the step of employing the values for the second set of parameters to control subsequent operation of the artificial lift equipment further comprises:

based upon the values for the second set of parameters:

optimizing production by the artificial lift equipment, or matching performance of the artificial lift equipment to wellbore application parameters.

* * * * *